US007677214B2

(12) United States Patent
Hale et al.

(10) Patent No.: US 7,677,214 B2
(45) Date of Patent: Mar. 16, 2010

(54) DEVICE FOR DEACTIVATION OF AT LEAST ONE CYLINDER OF AN INTERNAL COMBUSTION ENGINE

(75) Inventors: Thomas Hale, Northamptonshire (GB); Jonathan Hall, Northamptonshire (GB); Hermann Hoffmann, Stuttgart (DE); Mark Potts, Hertfordshire St. (GB)

(73) Assignee: MAHLE International GmbH, Stuttgart (DE)

( * ) Notice: Subject to any disclaimer, the term of this patent is extended or adjusted under 35 U.S.C. 154(b) by 273 days.

(21) Appl. No.: 11/809,271

(22) Filed: May 31, 2007

(65) Prior Publication Data

US 2007/0277756 A1 Dec. 6, 2007

(30) Foreign Application Priority Data

Jun. 1, 2006 (DE) ..... 10 2006 026 017

(51) Int. Cl.
*F01L 1/34* (2006.01)

(52) U.S. Cl. ..... 123/90.16; 123/90.43

(58) Field of Classification Search ..... 123/90.16, 123/90.39, 90.41, 90.43, 90.15, 90.17, 90.31
See application file for complete search history.

(56) References Cited

U.S. PATENT DOCUMENTS 3,964,455 A * 6/1976 Brown ..... 123/90.43
4,169,449 A 10/1979 Brock, Jr.
4,227,494 A 10/1980 Uitvlugt
4,249,488 A 2/1981 Siegla
4,305,356 A 12/1981 Walsh
4,337,738 A 7/1982 Bubniak et al.
4,380,219 A * 4/1983 Walsh ..... 123/198 F
4,411,229 A 10/1983 Curtis et al.
4,414,935 A 11/1983 Curtis et al.
4,462,353 A 7/1984 Arai et al.
5,655,487 A 8/1997 Maas et al.
6,220,213 B1 4/2001 Haas et al.
6,477,997 B1 * 11/2002 Wakeman ..... 123/90.16

(Continued)

FOREIGN PATENT DOCUMENTS

DE 42 10 254 A1 9/1993

(Continued)

*Primary Examiner*—Thomas E Denion
*Assistant Examiner*—Christopher Riemer
(74) *Attorney, Agent, or Firm*—Collard & Roe, P.C.

(57) ABSTRACT

The present invention relates to a device (1) for shutting down at least one cylinder of an internal combustion engine. The device (1) is connected to a rocker lever (2) which actuates an intake/exhaust valve (6) of the respective cylinder. In active cylinder operation, the rocker lever (2) executes an oscillating tilting movement about a pivot axle (10) which is situated in the area of the connection to the cylinder head (9), whereas when the respective cylinder is deactivated, the rocker lever (2) is lifted by the cylinder head (9) and therefore its pivot axle (10) is shifted in the direction of the connection of the rocker lever (2) to the valve of the respective cylinder. It is essential to the invention here that the device (1) is arranged essentially between the rocker lever (2) and the cylinder head (9) and the device has a guide element (11), a pivot axle element (12) displaceably mounted on the guide element (11) and a spring (15) stretched between two abutments (13, 14).

6 Claims, 3 Drawing Sheets

U.S. PATENT DOCUMENTS

Figure 1:
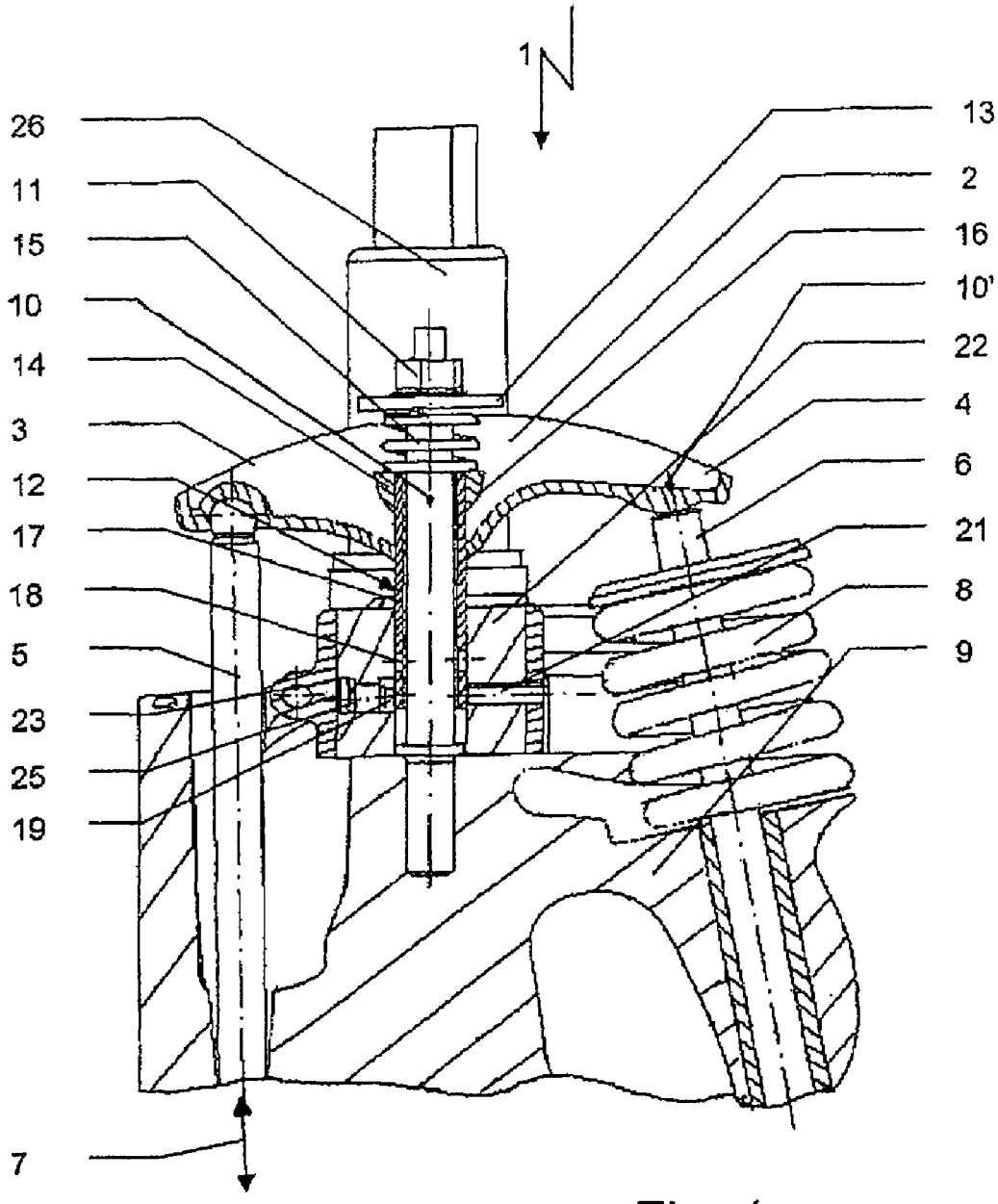

| | | | |
|---|---|---|---|
| 2005/0126528 | A1 | 6/2005 | Richardson |

FOREIGN PATENT DOCUMENTS

| | | | |
|---|---|---|---|
| DE | 93 19 435.8 | | 3/1994 |
| DE | 692 00 235 | T2 | 3/1995 |
| DE | 691 05 265 | T2 | 4/1995 |
| DE | 195 36 090 | A1 | 4/1997 |
| DE | 197 30 814 | A1 | 1/1999 |
| DE | 199 14 044 | A1 | 9/2000 |
| DE | 100 48 620 | A1 | 4/2002 |
| JP | 59-115416 | | 7/1984 |
| WO | WO 91/12415 | | 8/1991 |

* cited by examiner

DEVICE FOR DEACTIVATION OF AT LEAST ONE CYLINDER OF AN INTERNAL COMBUSTION ENGINE

CROSS REFERENCE TO RELATED APPLICATIONS

Applicant claims priority under 35 U.S.C. §119 of German Application No. 10 2006 026 017.1 filed Jun. 1, 2006.

The invention relates to a device for at least one cylinder of an internal combustion engine according to the preamble of Claim 1.

To be able to further reduce the energy consumption by motor vehicles, the possibility of shutting down one or more cylinders in internal combustion engines having a large number of cylinders during partial load operation of the vehicle, e.g., when driving downhill, is being considered. Shutting down one or more cylinders results in a significant reduction in fuel consumption because when the cylinders that have been deactivated follow passively, they consume much less fuel than the cylinders that have not been deactivated. Devices for shutting down individual cylinders are known from a large number of publications, the most proximate of which are mentioned briefly below.

U.S. Pat. No. 4,305,356 discloses a device for disabling cylinders, whereby the device is connected to a rocker lever that is in turn operatively connected to a valve lifter rod and an intake valve of the respective cylinder via both of its arms. In active cylinder operation, the rocker lever executes an oscillating tilting movement about a pivot axle which is situated in the area of the connection to the cylinder head and thus opens and/or closes the intake valve of the cylinder. When the respective cylinder is disabled, the device allows lifting of the rocker lever from the cylinder head and thereby a displacement of the pivot axle in the direction of the connection of the rocker lever to the intake valve of the respective cylinder. The device for disabling the cylinder is essentially arranged above the rocker lever, which therefore increases the overall height. The device is actuated by perforated plates that work mechanically.

U.S. Pat. No. 4,169,449 describes a device for de-activating at least one cylinder of an internal combustion engine which is arranged partially above the rocker lever and also in a valve lifter rod which follows the cam. The device described here is hydraulically actuated, which necessitates a hydraulic pump.

In general, the overall height of the internal combustion engine is increased by an arrangement of the device for deactivation of a cylinder above the rocker lever, whereas when the device is arranged in the valve lifter rod, the moving mass increases when the cylinder is activated as well as when the cylinder is deactivated.

Additional devices for cylinder deactivation are known, for example, from several United States patents, i.e., U.S. Pat. No. 4,380,219, U.S. Pat. No. 4,337,738, U.S. Pat. No. 4,227,494, U.S. Pat. No. 4,249,488, U.S. Pat. No. 4,411,229, U.S. Pat. No. 4,414,935 and U.S. Pat. No. 4,462,353.

The invention relates to the problem of providing an embodiment for a device of the generic type which is characterized in particular by a low overall height, simple input of the energy required to activate it and by retaining the moving component masses in the activated state, i.e., in the connected state of the controlled cylinder.

This problem is solved by the subject of the independent Claim 1. Advantageous embodiments are the subject of the dependent claims.

This invention is based on the general idea of arranging a generic device for deactivation of at least one cylinder of an internal combustion engine essentially between the rocker lever and the cylinder head and designing the device so that it comprises a guide element fixedly connected to the cylinder head and a pivot axle element arranged displaceably on the guide element for pivotable mounting of the rocker lever. In addition, the inventive device includes a spring stretched between two abutments, whereby the first abutment is fixedly connected to the guide element and the second abutment is fixedly connected to the pivot axle and thereby prestresses the pivot axle element in the direction of a locking position. The inventive device is thus arranged in a space-saving manner between the rocker lever and the cylinder head, which minimizes the installation space, so that the overall height of the internal combustion engine can be reduced in comparison with an arrangement of the device above the rocker lever. In addition, the inventive device is arranged fixedly on the cylinder head so that a locking mechanism that operates hydraulically, for example, can be supplied with power and/or activated via hydraulic lines running in the cylinder head. This eliminates hydraulic lines on moving components of the device so as to yield an essential structural advantage. Furthermore, the cost of the inventive device can be reduced significantly by omitting external hydraulic lines on moving parts of the device, which therefore yields competitive advantages. In addition, the basic design of the internal combustion engine, e.g., the casting mold of the engine housing, need not be altered because the inventive device is not integrated but can be added optionally. This yields mainly more extensive possible uses for existing engine concepts.

A hydraulic supply for a locking element is expediently provided in an insert in which the pivot lever element is displaceably mounted, in a housing surrounding the former and in a cylinder head. This locking element is mounted in the insert across the axis of the guide element and is aligned so that it engages in an opening of the pivot lever element when actuated. The hydraulic lines integrated into the insert and/or into the housing and the cylinder head cause them not to be exposed to any external wear in contrast with freely installed lines and the lines are also accommodated in a space-saving manner in the cylinder head and/or inside the device of at least one cylinder. Such hydraulic supply means, e.g., hydraulic channels can be produced with the cylinder head or they may already exist so that a decision need be made only at the time of production or assembly of the combustion engine as to whether or not an inventive device is arranged on the cylinder head. The same cylinder heads may be used in both cases, thereby making it possible to reduce the variety of parts and also achieving cost advantages in comparison with the competition.

In an advantageous embodiment of the inventive approach, the locking element can be operated hydraulically, pneumatically or electrically. As described in the preceding section, the hydraulic lines supplying hydraulic medium to the locking element may be integrated into the device itself and/or into the cylinder head, whereas an electric or pneumatic actuator drive may be integrated either into the device, e.g., the insert or the cylinder head in the same way in the case of an electrically or pneumatically operable locking element. In both cases the actuating device for the locking element is integrated into the cylinder head and/or into the device in a space-saving and wear-resistant manner.

Advantageous exemplary embodiments are illustrated in the drawings and described in greater detail below.

Figure 2:
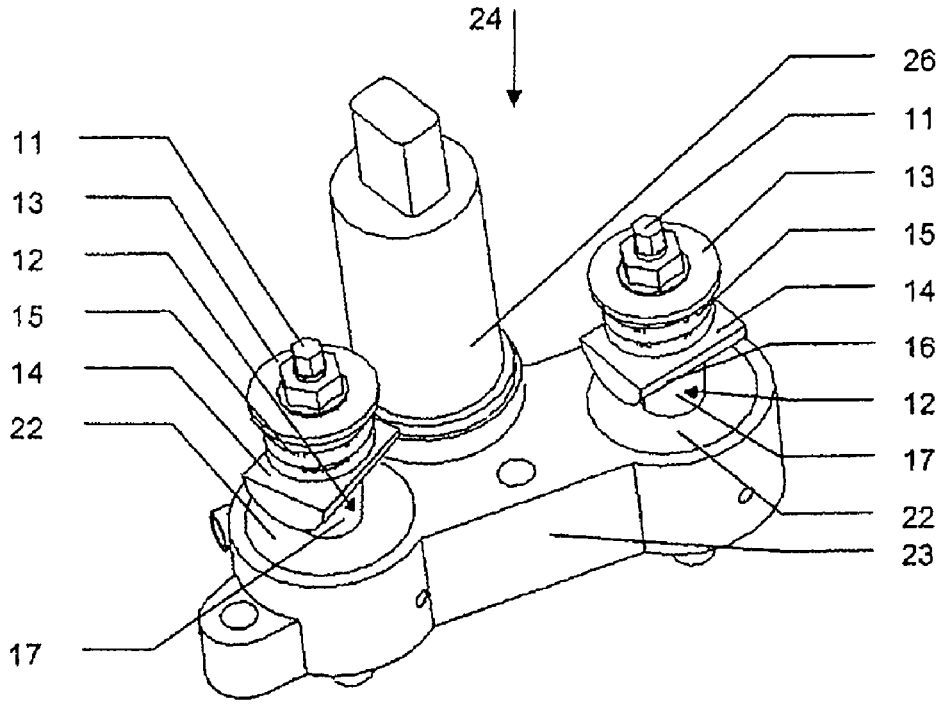
Figure 3:
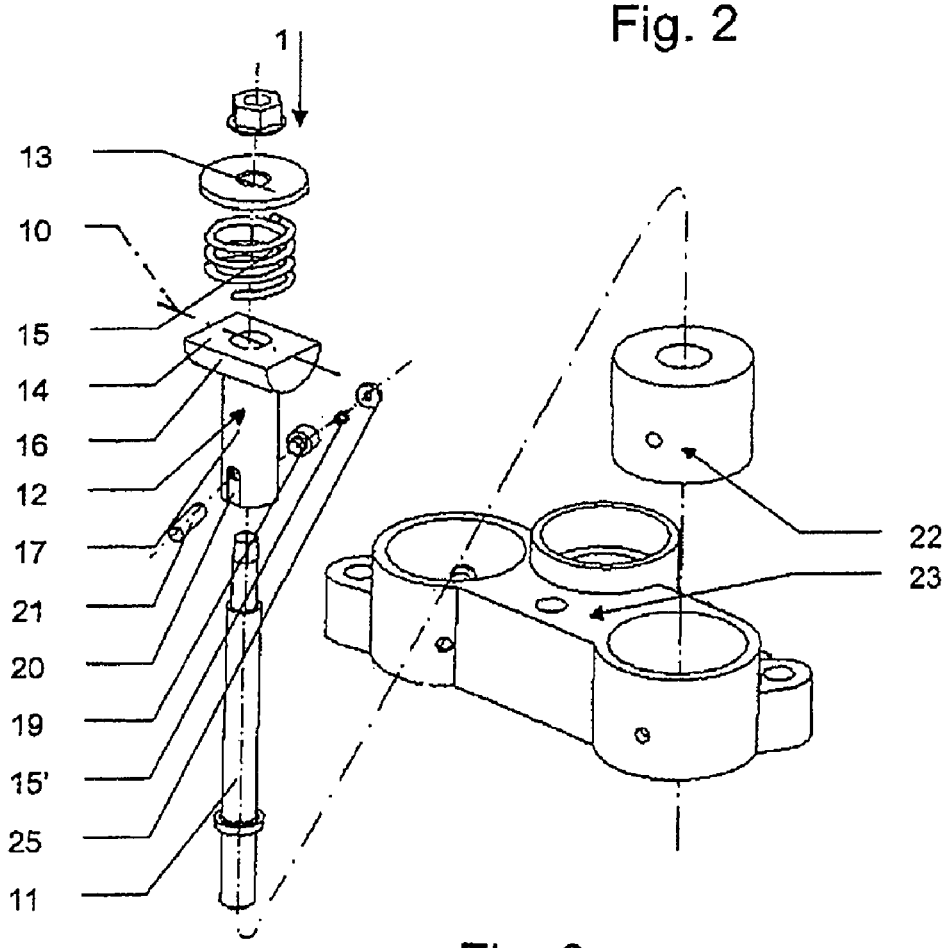
Figure 4:
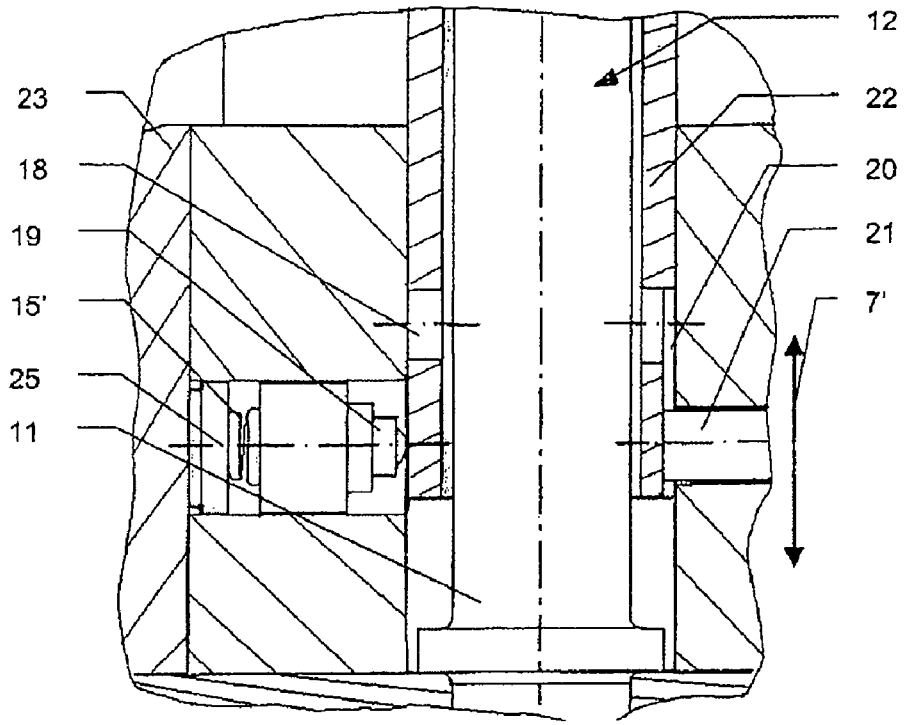
Figure 5:
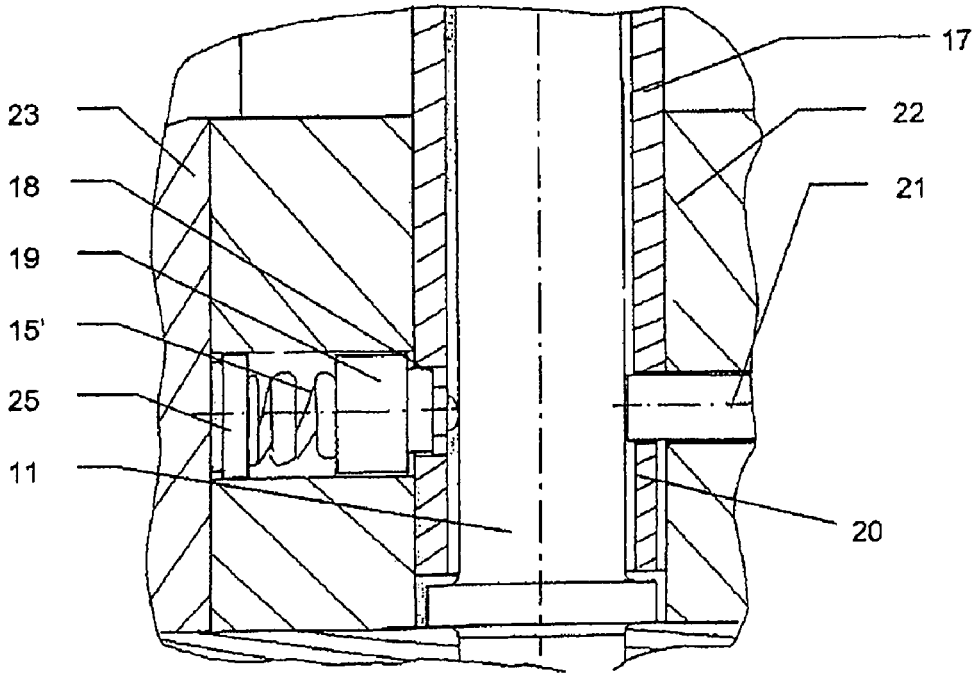

They each show schematically,

FIG. 1 a sectional diagram through an inventive device arranged on a cylinder head, FIG. 2 a device module having two inventive devices, FIG. 3 a device module and a device, each in an exploded diagram, FIG. 4 a detailed drawing in the area of a locking element when the cylinder is deactivated, FIG. 5 a diagram like that in FIG. 4 but with the cylinder activated.

According to FIG. 1, an inventive device 1 is shown for deactivation of at least one cylinder of an internal combustion engine which is not otherwise shown here. The device 1 is connected to a rocker lever 2, which has a first arm 3 and a second arm 4. By means of the first arm 3, the rocker lever 2 is connected to a valve lifter rod 5, which has a cam follower on its end facing away from the first arm 3 and follows an oscillating movement of a cam (not shown) with this cam follower. The rocker lever 2 is operatively connected to an intake/exhaust valve 6 of the respective cylinder via its second arm 4. In active cylinder operation, the valve lifter rod 5 moves up and down along the direction of movement 7 because of a cam arranged on a camshaft, thereby causing an upward movement of the first arm 3 of the rocker lever 2 and thus a downward movement of the second arm 4 of the rocker lever 2, for example, whereupon it forces the valve 6 downward against a spring force exerted by a spring 8 and thereby opens it. With a downward movement of the valve lifter rod 5, there is thus a downward movement of the first arm 3 and an upward movement of the second arm 4 of the rocker lever 2, whereupon the valve 6 moves upward and thereby closes. In active cylinder operation, the rocker lever 2 thus executes an oscillating tilting movement about a pivot axle 10 which is in the range of the connection to a cylinder head 9.

In general, the device 1 is designed so that when the respective cylinder is deactivated, lifting of the rocker lever 2 from the cylinder head 5 and thereby a shifting of the pivot lever 10 in the direction of the connection of the rocker lever 2 to the intake/exhaust valve 6 of the respective cylinder are made possible so that when the cylinder is deactivated, the rocker lever 2 is pivoted about the pivot axle 10' and therefore opening of the valve 6 is suppressed.

According to this invention, the device 1 is now essentially arranged beneath the rocker lever 2, i.e., between the rocker lever 2 and the cylinder head 9, which reduces the overall height in comparison with an arrangement above the rocker lever and thereby reduces the total installed space required by the internal combustion engine.

On the basis of FIGS. 2 and 3, the individual components of the inventive device 1 shall now be explained for deactivation of the at least one cylinder. The device 1 comprises according to FIG. 3 a guide element 11 which may also be designed as a bolt and which is fixedly connected to the cylinder head 9 in the installed state, in particular being screwed there (see FIG. 1). In addition, the device 1 includes a pivot axle element 12 that can be displaced on the guide element 11 for pivotable mounting of the rocker lever 2, whereby the pivot axle element 12 can be locked in place for the active cylinder operation. In addition, the device 1 includes a spring 15 stretched between two abutments 13, 14, the first abutment 13 being fixedly connected to the guide element 11 and the second abutment 14 being fixedly connected to the pivot axle 10 and whereby the spring 15 prestresses the pivot axle element 12 in the direction of a locking position (downward according to FIG. 3). The pivot axle 10 is formed by a cylinder half, whereby a lateral surface 16 of the cylinder half forms a sliding surface for the rocker lever 2 (see also FIG. 1). In FIG. 3 the pivot axle element 12 below the pivot axle 10 has a sliding element 17 which is designed in the form of a tube and/or a sleeve and has an opening 18 at its lower end (see FIGS. 4 and 5) for a locking element and an axial slot 20 that is open at one end axially and is arranged opposite the former.

The guide element 11 is arranged coaxially inside the sliding element 17 and/or the pivot axle element 12, whereby the pivot axle element 12 is designed to be axially displaceable over its sleeve-shaped sliding element 17 with respect to the guide element 11.

In addition, a guide pin 21 is provided, arranged across the axis of the guide element 11 in an insert 22 and engaging in the axial slot 20 of the sliding element 17 that is open at the end and guides it. If FIG. 3 is considered, it can be seen that the insert 22 surrounds the pivot axle element 12 and/or the pivot axle element 12 is displaceably mounted in the insert 22. In the installed state, the insert 22 is surrounded by a housing 23, preferably made of aluminum. In contrast with that, the insert 22 is preferably made of steel. The insert 22 is necessary to be able to install the guide pin 21 and/or the locking element 19. It is also conceivable for the insert 22 to be in one piece, manufactured in one piece.

As mentioned initially, the device 1 is designed for shutting down at least one cylinder of an internal combustion engine, whereby it is also conceivable for two devices 1 to be combined in one device module 24.

According to FIGS. 4 and 5, the locking element 19 is displaceably mounted in the insert 22 across the axis of the guide element 11 and is aligned so that it engages in the opening 18 of the sleeve-shaped sliding element 17 of the pivot axle element 12 when actuated. As also indicated by FIGS. 4 and 5, the locking element 19 is prestressed by a spring 15' in the direction of the opening 18. It is also conceivable here for the locking element 19 to be prestressed in the opposite direction or for the locking element 19 to be acted upon by hydraulic medium on both ends, so that the spring 15' can be omitted. The spring 15' is supported on the locking element 19 on the one end and on a third abutment 25 at the other end, said third abutment being arranged in the area of the transition between the insert 22 and the housing 23.

The locking element 19 is actuated by a switch mechanism 26, preferably hydraulically, but electric or pneumatic actuation is also conceivable. Such electric or pneumatic actuation may be accomplished by a coil and/or a magnet or a pneumatic cylinder, as illustrated in FIG. 2. On the basis of the inventive arrangement of the device 1 between the rocker lever 2 and the cylinder head 9, it is conceivable for a hydraulic supply to be provided, in the insert 22, in the housing 23 and in the cylinder head 9 in the case of a hydraulically actuated locking element 19, so that no external hydraulic line need be provided. This offers the great advantage that the hydraulic supply of the locking element is integrated into the device 1 in a space-saving and wear-protected manner, and in particular, this makes it possible to avoid hydraulic supply of moving parts, which usually poses major problems. An external hydraulic supply, which can also be connected only to non-moving parts, is of course also conceivable.

FIG. 4 shows a condition in which the respective cylinder is deactivated, i.e., in which the rocker lever 2 rotates about the pivot axle 10' (see FIG. 1). This is achieved by moving the locking element 19 out of the opening 18 to the extent that the sliding element 17 of the pivot axle element 12 can move up and down according to the direction of movement 7' in FIG. 4. However, the locking element 19 is inserted into the opening 18 according to FIG. 5 and prevents the sliding element 17 and/or the pivot axle element 12 from moving up and down, so that the rocker lever 2 according to FIG. 1 pivots about the pivot axle 10 and thereby periodically opens and/or closes the intake/exhaust valve 6.

In comparison with the cylinder deactivation operations known from the state of the art, the inventive device 1 offers the great advantage that it is not necessary to move an increased mass in activated cylinder operation, so higher rotational speeds can be achieved and fuel consumption can be reduced at the same time. In addition, a smaller overall height can be achieved due to the device 1 arranged between the rocker lever 2 and the cylinder head 9, which is also a great advantage owing to the restricted engine space conditions. Furthermore, the inventive device 1 can be designed and/or made available in a device module 24 such that even traditional internal combustion engines can be retrofitted with the inventive device 1 and/or the inventive device module 24. It is of course possible to deactivate either just one cylinder by means of the inventive device or to deactivate several cylinders with several such devices 1 in case of need.

All the features depicted in the description and in the following claims may be essential to the invention either alone or combined in any desired form.

The invention claimed is:

1. A device (1) for deactivation of at least one cylinder of an internal combustion engine, whereby the device (1) is connected to a rocker lever (2) which is operatively connected via a first arm (3) to a valve lifter rod (5) and via a second arm (4) to an intake/exhaust valve (6) of the respective cylinder, the rocker lever (2) executes the oscillating tilting movement about a pivot axle (10) situated in the area of the connection to the cylinder head (9) in active cylinder operation and thus causes the intake/exhaust valve (6) of the cylinder to open/close, the device (1) is designed so that it permits the rocker lever (2) to be lifted up by the cylinder head (9) when the respective cylinder is deactivated, thereby displacing the pivot axle (10) in the direction of the connection of the rocker lever (2) to the intake/exhaust valve (6) of the respective cylinder, the device (1) is arranged essentially between the rocker lever (2) and the cylinder head (9), the device (1) comprises a guide element (11) that is fixedly connected to the cylinder head (9), a pivot axle element (12) arranged displaceably on the guide element (11) for pivotable mounting of the rocker lever (2), whereby the pivot axle element (12) can be locked for the active cylinder operation, a spring (15) stretched between two abutments (13, 14), the first abutment (13) of which is fixedly connected to the guide element (11) and the second abutment (14) of which is fixedly connected to the pivot axle (10) and whereby this spring (15) prestresses the pivot axle element (12) in the direction of a locked position, wherein the pivot axle element (12) has a sliding element (17) which is designed in the form of a sleeve and has an opening (18) for a locking element (19) mounted on the cylinder head end, this opening being situated on its end area on the cylinder head end, the pivot axle element (12) ends with a cylinder half that forms the pivot axle (10) and is arranged across the axis of the sliding element (17) on the rocker lever end, whereby a lateral surface (16) of the cylinder half forms a sliding surface for the rocker lever (2), the guide element (11) is arranged coaxially inside the pivot axle element (12), the pivot axle element (12) is designed to be axially displaceable over the sleeve-shaped sliding element (17) in relation to the guide element (11), the locking element (19) is actuated by a switch mechanism (26).

2. The device according to claim 1, wherein an insert (22) is provided, surrounding the pivot axle element (12) and arranged inside a housing (23), and/or the insert (22) and the housing (23) are made of one piece.

3. The device according to claim 2, wherein the locking element (19) is in the insert (22) so it can be displaced across the axis of the guide element (11) and is aligned so that it engages in the opening (18) of the sleeve-shaped sliding element (17) in order to lock the sliding element (17), the locking element (19) is prestressed either in the direction of the opening (18) or in the opposite direction, or the locking element (19) can be acted upon with hydraulic medium on both ends.

4. The device according to claim 1, wherein the locking element (19) is hydraulically, electrically or pneumatically operable.

5. The device according to claim 2, wherein a hydraulic supply for the locking element (19) is provided in the insert (22), in the housing (23) and in the cylinder head (9), or an external hydraulic supply is provided for the locking element (19).

6. The device module (24) that can be arranged on a cylinder head and has at least one device (1) according to claim 1.

* * * * *